US007779646B2

(12) United States Patent
Görz

(10) Patent No.: US 7,779,646 B2
(45) Date of Patent: Aug. 24, 2010

(54) REFRIGERATING DEVICE WITH COOLING OF CIRCULATING AIR

(75) Inventor: Alexander Görz, Aalen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 497 days.

(21) Appl. No.: 11/919,282

(22) PCT Filed: Mar. 30, 2006

(86) PCT No.: PCT/EP2006/061173

§ 371 (c)(1),
(2), (4) Date: Oct. 24, 2007

(87) PCT Pub. No.: WO2006/120076

PCT Pub. Date: Nov. 16, 2006

(65) Prior Publication Data

US 2009/0308097 A1 Dec. 17, 2009

(30) Foreign Application Priority Data

May 10, 2005 (DE) ..... 10 2005 021 535

(51) Int. Cl.
*F25D 13/02* (2006.01)

(52) U.S. Cl. ..... 62/442

(58) Field of Classification Search ..... 62/419, 62/442, 444, 447

See application file for complete search history.

(56) References Cited

U.S. PATENT DOCUMENTS 3,122,899 A * 3/1964 Costantini et al. ..... 62/419
3,590,594 A 7/1971 Arend
7,594,412 B1 * 9/2009 Dren ..... 62/340

FOREIGN PATENT DOCUMENTS

DE 24 53 796 5/1976
JP 4-363572 12/1992

OTHER PUBLICATIONS

International Search Report PCT/EP2006/061173.

* cited by examiner

*Primary Examiner*—Melvin Jones
(74) *Attorney, Agent, or Firm*—James E. Howard; Andre Pallapies

(57) ABSTRACT

The invention relates to a housing that encloses an inner chamber, a cold air pipe that extends in a wall of the housing separated from the inner chamber by an insulating layer, and a transition piece that connects one end of the cold air pipe to an air inlet of the inner chamber. The transition piece includes a guide wall that extends from one end of the insulating layer to an edge of the air inlet adjacent to the one end of the insulating layer, connecting a wall of the cold air pipe that is adjacent to the insulating layer to the adjacent edge of the air inlet in a continuous manner.

7 Claims, 5 Drawing Sheets

REFRIGERATING DEVICE WITH COOLING OF CIRCULATING AIR

The present invention relates to a refrigerating device with cooling of circulating air. In such a refrigerating device, the evaporator is usually accommodated in a chamber which is separated from the inner chamber provided for the storing of refrigerated goods, and a cold-air pipe out of which air cooled on the evaporator flows into the inner chamber, extends in a wall of the housing of the refrigerating device. The purpose of such a cold-air pipe can vary. In multiflow devices, the cold-air pipe runs along a wall of a storage area of the inner chamber that is to be supplied with this cold air, and it has a plurality of through-apertures distributed over its length so as to release the cold air to this storage area in a spatially distributed manner. A transition piece can be provided at the downstream end of such a cold-air pipe, said transition piece directing the air flow into a last air inlet aperture of the inner chamber. Such a cold-air pipe does not need to be insulated from the storage area along which it flows since the cold air conducted in it serves in any case in cooling this storage area.

In refrigerating devices with storage areas which are temperature-controlled independently of one another a cold-air pipe that extends along a first storage area may be required in order to conduct cold air from the evaporator to a second storage area. It is useful in such a refrigerating device to provide an insulating layer between the cold-air pipe and the first storage area. Also, a transition piece is needed on the end of the cold-air pipe in order to guide the air into the second storage area. If, however, the insulating layer ends shortly before reaching the air inlet aperture, cross-sectional discontinuities in the cold-air pipe result therefrom which cause turbulence, thereby increasing the flow-resistance of the cold-air pipe in an undesired manner.

The object of the present invention is to indicate a refrigerating device with cooling of circulating air, in which the flow resistance to which the cold air is exposed on its way to an air inlet aperture of the inner chamber is minimized.

The object is achieved in that in a refrigerating device comprising a housing which encloses an inner chamber, a cold-air pipe which runs in a wall of the housing, separated from the inner chamber by an insulating layer, and a transition piece which connects one end of the cold-air pipe to an air inlet aperture of the inner chamber, the transition piece comprises a guide wall which connects a wall of the cold-aid pipe which is adjacent to the insulating layer to an edge of the air inlet aperture adjacent to the end of the insulating layer in a continuous manner.

In order to prevent any turbulence from occurring on the guide wall, the latter is preferably continuously curved between the end of the cold-air pipe and the aperture.

In a particularly preferred embodiment, the transition piece comprises an outer shell which connects in a continuously curved manner a side of the cold-air pipe facing away from the inner chamber to an edge of the air inlet aperture facing away from the end of the cold-air pipe and fits foam-tight with an inner skin of the wall. Such an outer shell can be used uniformly both in a refrigerating device comprising an insulating layer between cold-air pipe and inner chamber and in a refrigerating device which does not have such an insulating layer.

The guide wall is preferably incorporated in the shell of the transition piece. In this way, the guide wall is shielded by the shell from insulating foam filling the wall of the housing and no allowance has to be made when attaching the guide wall for this guide wall to fit foam-tight with any other parts.

In order to fix the position of the guide wall in the shell, the shell can be furnished with a ridge protruding into its interior, which ridge penetrates a slot of the guide wall.

The invention is particularly usefully applicable in a refrigerating device, the inner chamber of which is subdivided by a partition into various storage areas and in which the cold-air pipe and the air inlet aperture are located on different sides of the partition.

If the wall of the housing of the refrigerating device has a metal inner skin, this should, in order to guarantee an effective thermal separation between the storage areas on different sides of the partition, preferably be interrupted between the end of the insulating layer and the edge of the air inlet aperture adjacent to said end.

Further features and advantages of the invention will emerge from the descriptions below of exemplary embodiments with reference to the attached drawings, in which.

Figure 1:
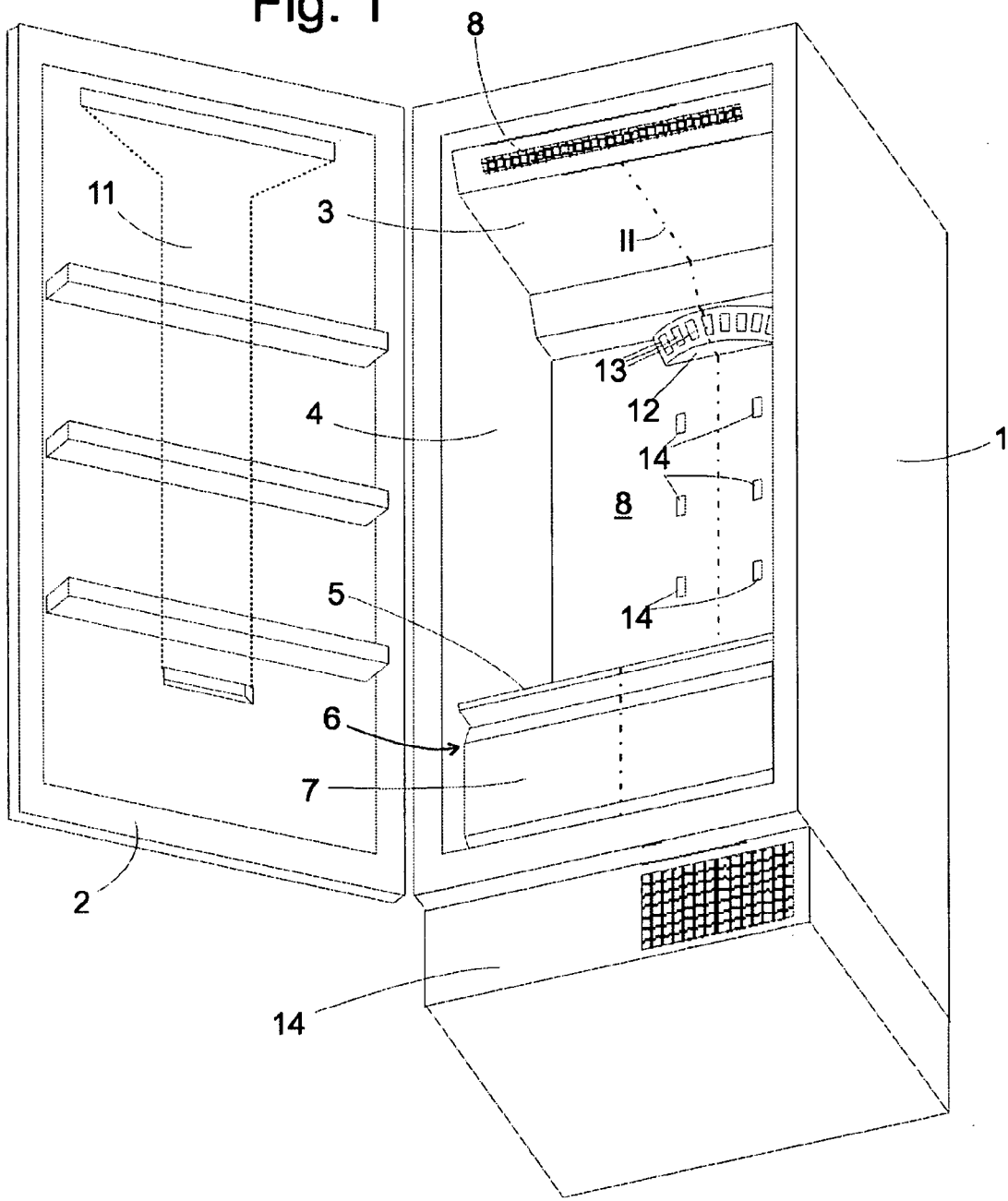
FIG. 1 shows a perspective view of a refrigerating device in which the present invention is realized.

FIG. 1 shows a perspective view of a refrigerating device, which will be used to illustrate the present invention. The device has a body 1 and a door 2. The interior of the body 1 is subdivided into an evaporator area 3 above below the top of the body 1, a first refrigerating area 4 and, separated from this by an insulating partition 5, a second refrigerating area 6. A pull-out box 7 is accommodated in the second refrigerating area 6. The first refrigerating area 4 is normally subdivided by a plurality of refrigerated-goods holders into compartments lying one above the another, but said compartments have been omitted in the figure so as to be able to show the back wall 8 of the body 1.

On the front of a partition 9 (see FIG. 2) separating the evaporator area 3 from the first refrigerating area 4, an air inlet aperture 10 is formed through which air from the first refrigerating area 4 can enter the evaporator area 3. Pipes through which air from the second refrigerating area 6 can flow to the evaporator area 3 can—not visible in the figure—run in side walls of the body 1; another possibility, shown in the figure, is an air pipe 11 in the interior of the door 2 which begins at the height of the second refrigerating area 6 and ends opposite the air inlet aperture 10, the course of said air pipe being indicated in the figure by dashed lines.

Adjacent to the back wall 8, a distributor cap 12 is fastened to the partition 9, on which distributor cap a large number of air holes 13 are formed, through which cold air originating from the evaporator area 3 is distributed in various directions in the upper part of the first refrigerating area 4. Located on the back wall 8 below the distributor cap 12 are several pairs of apertures 14 out of which cold air can likewise flow. The height of these pairs of apertures 14 is chosen such that if refrigerated-goods containers are mounted in the first refrigerating area 4, each pair of apertures 14 supplies one compartment.

Figure 2:
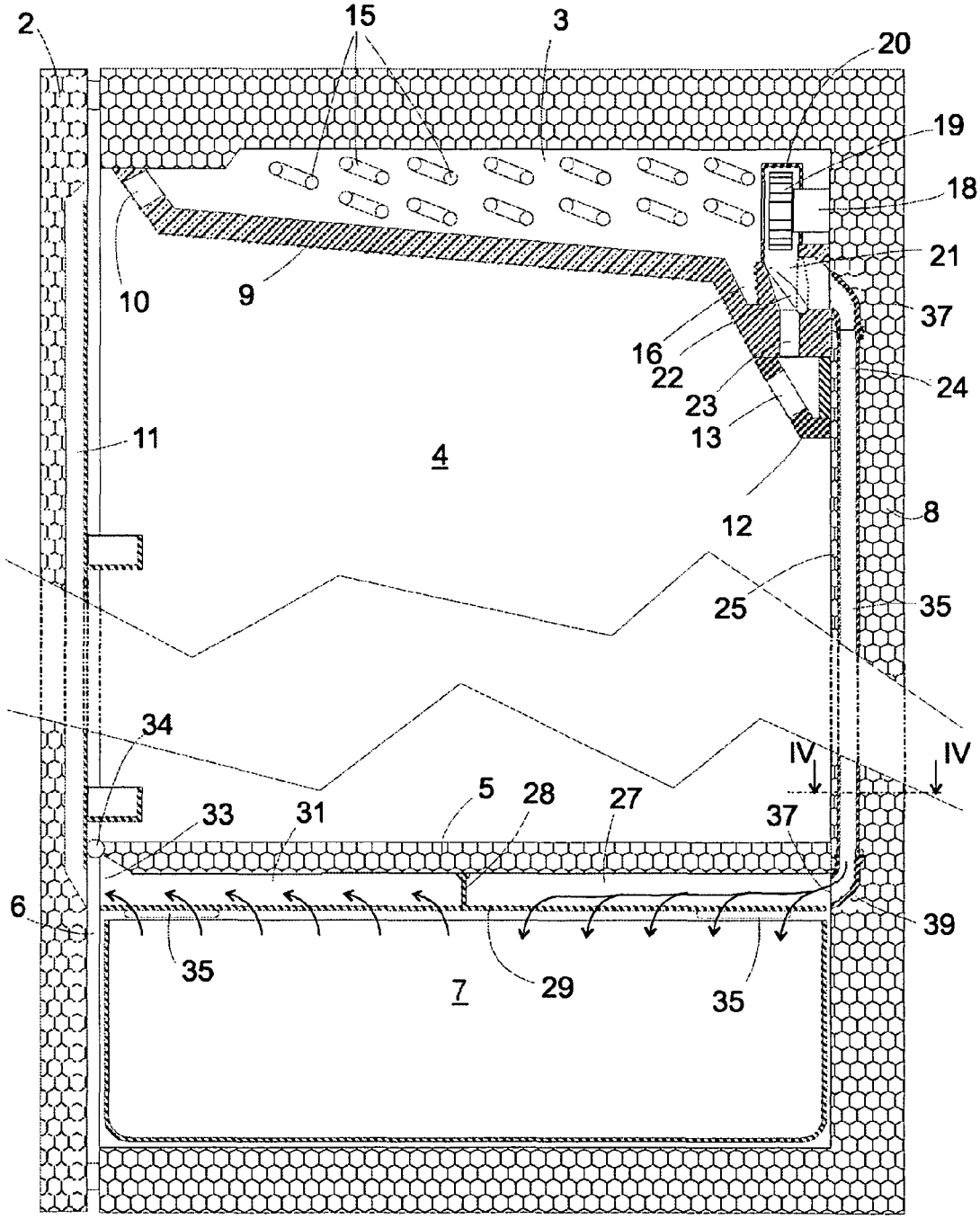
FIG. 2 shows a section through the refrigerating device of FIG. 1 along the line II from FIG. 1.
Figure 6:
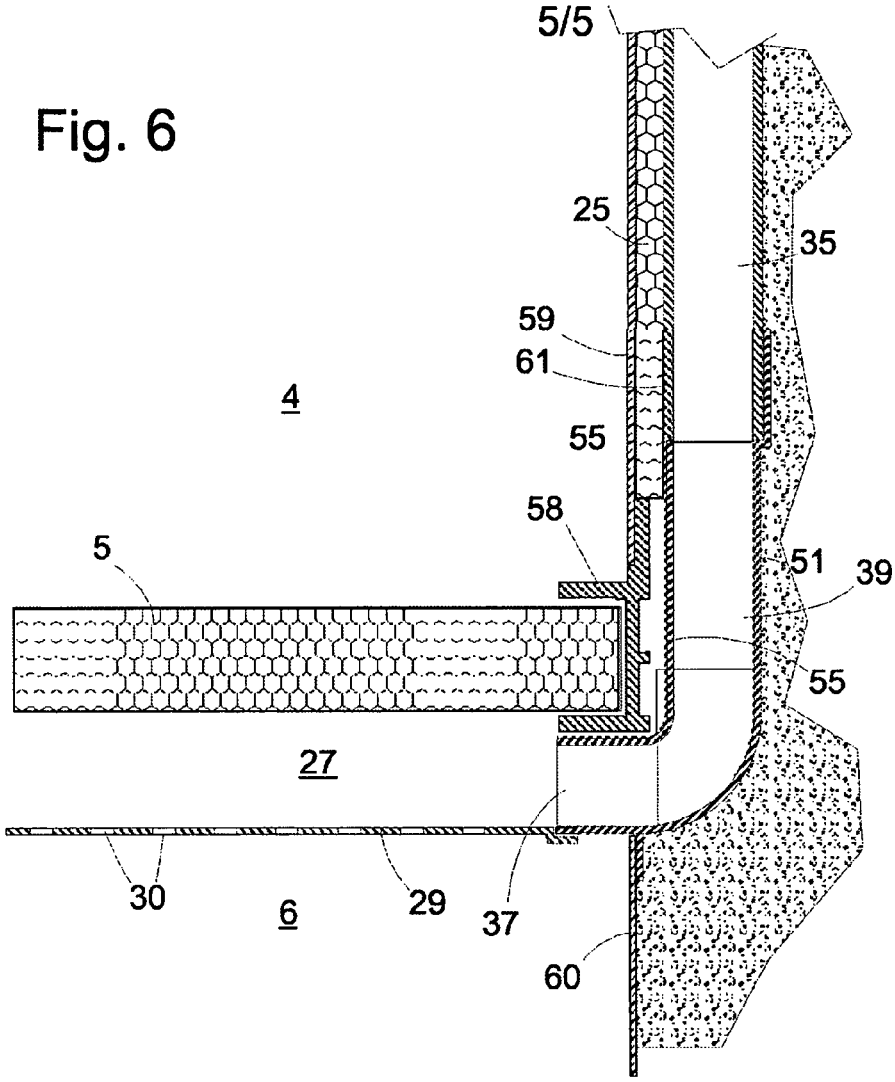
FIG. 6 shows a schematic section through the back wall of the refrigerating device.

FIG. 2 shows the refrigerating device of FIG. 1 in a section along a median plane extending vertically and in the direction of depth of the body 1, said plane being represented in FIG. 1 by a dot-dash line II. In the interior of evaporator area 3, cooling coils of an evaporator 15 can be seen in the section, toward which air penetrating through the air inlet aperture 10 flows. Toward the back wall 8 of the body 1, the partition 9 is tilted toward a trough 16 in which condensed water dripping from the evaporator 15 collects. The condensed water reaches an evaporator accommodated in the base area 17 (see FIG. 1) of the body 1 via a pipeline that is not shown.

A fan is accommodated behind the trough 16, adjacent to the back wall 8, said fan comprising a motor 18, a blade wheel 19 driven by said motor, and a housing 20. An intake aperture is fashioned on the front of the housing 20, in an axial direction of the blade wheel 19. The top half of the housing 20 runs in a circumferential direction tightly about the blade wheel 19; the housing 20 is open toward the bottom such that air which is accelerated radially outwardly by a rotation of the blade wheel 19 flows downward into a chamber 21.

Figure 3:
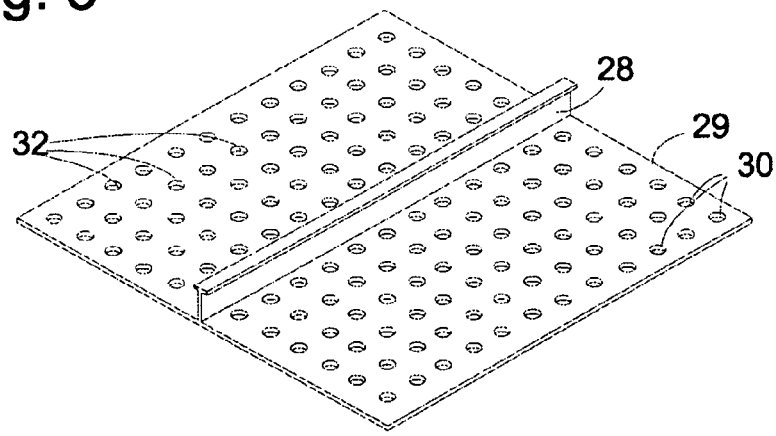
FIG. 3 shows a perspective view of a dividing wall which separates a cold-air distribution zone from a storage zone of the refrigerating device.

A swivelable flap 22 is accommodated in this chamber 21. In the position shown in the figure, the flap 22 blocks a cold-air supply aperture 23, which leads vertically down to the first refrigerating area 4. The air is in this way forced toward the back wall 8 and into a cold-air supply pathway 24 which in the interior of the back wall 8, separated from the first refrigerating area 4 by a thin insulating layer 25, leads to the second refrigerating area 6. The cold-air supply pathway is composed of a first transition piece 38, which lengthens the chamber 21 into the back wall 8, an air pipe, formed by an extruded profile 35, which extends in the back wall 8 in a straight line downward along the first refrigerating area 4, and a lower transition piece 39 which connects to the lower end of the extruded profile 35 and directs the air into the second refrigerating area 6 through a cold-air feed aperture 37 cut into the inner skin of the back wall 8. In the second refrigerating area 6, the cold air passes into a first distributor chamber 27, which perpendicular to the sectional plane of FIG. 2 extends over the entire width of the second refrigerating area 6 and over approximately half of its depth as far as a vertical dividing wall 28. The vertical dividing wall 28 is molded out of plastic in one piece with a horizontal dividing wall 29. The horizontal dividing wall 29 forms the floor of the first distributor chamber 27 and separates this from a storage zone of the second refrigerating area lying thereunder. As can be seen in FIG. 3, which shows a perspective view of the component forming the dividing walls 28, 29, the dividing wall 29 is furnished with a large number of apertures 30 (see FIG. 3) via which cold air fed to the distributor chamber 27 via the supply pathway 24 enters, distributed over a large area, the storage zone and the pull-out box 7 which is accommodated therein and is open at the top.

A second distributor chamber 31 is located, mirror-image-like relative to the first distributor chamber 27, between the vertical dividing wall 28 and the door 2. The widened upper edge of the dividing wall 28 abutting the partition 5 between the refrigerating areas 4 and 6 separates the distributor chambers 27, 31 from one another and prevents or limits any direct transfer of cold air from the chamber 27 to the chamber 31. In order to create an effective air block between the chambers 27, 31, the upper edge of the dividing wall 28 can be fitted with a sealing strip, not shown in the figure, which is compressed between it and the partition 5 and produces a sealed contact. A narrow gap between the upper edge of the dividing wall 28 and the partition 5 can, however, also be accepted, provided the air flow through this gap remains small relative to that which flows from the first distributor chamber 27 into the pull-out box 7.

From the pull-out box 7 the air flows through apertures 32, which are formed in the horizontal dividing wall 28 between the storage zone and the second distributor chamber 31, down into the latter.

Opposite an air outlet aperture 33 on the side of the second distributor chamber 31 facing the door is an inlet aperture for the air pipe 11 running through the door 2 back to the evaporator area 3. A sealing strip 34 fastened to the front edge of the partition 5 and compressed between said front edge and the door 2 prevents any transfer of air out of the distributor chamber 31 into the first refrigerating area 4 and thereby ensures that the two refrigerating areas 4, 6 can be separated and loaded with cold air without affecting one another.

The component forming the dividing walls 28, 29 is removably assembled in the second refrigerating area 6; in the case examined here, its lateral edges lie on ridges 35 which respectively project by several millimeters out of the side walls of the second refrigerating area 6. This gives the user the facility to remove the dividing walls 28, 29 and to fill the pull-out box 7 with refrigerated goods beyond its top edge, should this be necessary.

If the flap 22 hinged to a partition 26 between the cold-air supply aperture 23 and the cold-air supply pathway 24 is brought to a vertical position, represented in the figure as a dotted outline, it blocks the cold-air supply pathway 24, and the flow of cold air reaches the distributor cap 12 through the cold-air supply aperture 23. In the figure, one of the air holes 13 can be seen through which air flows out of the distributor cap 12 into the first refrigerating area 4. The interior of the distributor cap 112 communicates via apertures which are not visible in the figure with distributor pipes 48 (see FIG. 4) which run in the back wall 8 alongside the cold-air supply pathway 24 and feed the apertures 14.

Figure 4:
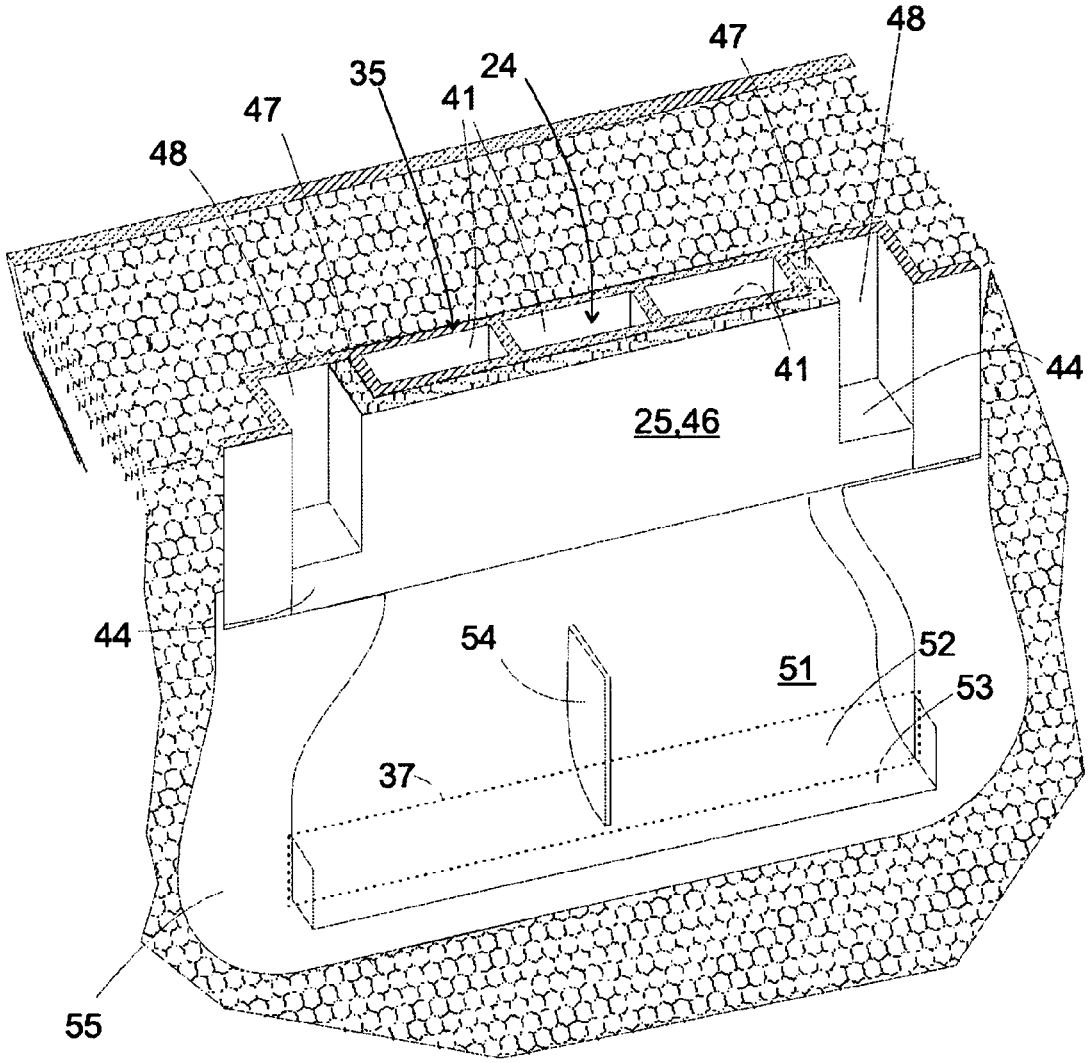
FIG. 4 shows a perspective view of a piece of the back wall of the refrigerating device from FIG. 1, wherein an inner skin of the housing wall and a guide wall at the lower end of the cold-air pipe which is shown are omitted.

FIG. 4 shows an excerpt from the back wall 6 of the body 1, cut along the line labeled IV-IV in FIG. 2, and partially in perspective view. The inner skin of the back wall 8 is omitted so as to be able to show more clearly the structure of the air pipes running in said back wall. Embedded in the layer of insulating foam of the back wall is the extruded profile 35, from which three channels 41 with a closed rectangular cross-section together form the cold-air supply pathway 24. The insulating layer 25 is the floor of a preformed flat U profile 46, assembled prior to the packing of the back wall 8 with foam material between the channels 41 and the inner skin of the back wall, lateral limbs 47 of which laterally border the channels 41. Ends of the aforementioned distributor pipes 48 can be seen on the other side of the limbs 47 of the U-profile 46, onto which ends the apertures 14 of the back wall 8 open and which are fed with air via through-apertures, not shown, to the distributor cap 12. They are also separated by the extruded profile from the insulating foam of the back wall 8. Since the distributor pipes 48 serve to distribute cold air in various compartments of the first refrigerating area 4, they are not insulated against the inner skin. They are closed off at the height of the partition 5 by lateral projections 44 of the insulation profile 46.

Above the lower end of the extruded profile 35, a flat shell 51 is tilted over, on the foam side, forming a part of the transition piece 39 shown in FIG. 2. The vertical back wall of the shell 51 changes via a uniformly curved lower section 52 into a horizontal plate 53 which, through the cold-air feed aperture 37 indicated in the figure as a dashed outline, engages with the second refrigerating area 6. The lower area of the shell 51 is divided in two by a vertical ridge 54.

A wide flange 55 surrounding the shell 51 is provided so as to be glued in a laminar manner to the inner skin of the back wall 8 and in this way to seal the interior of the shell 51 from the surrounding insulating-foam material.

Figure 5:
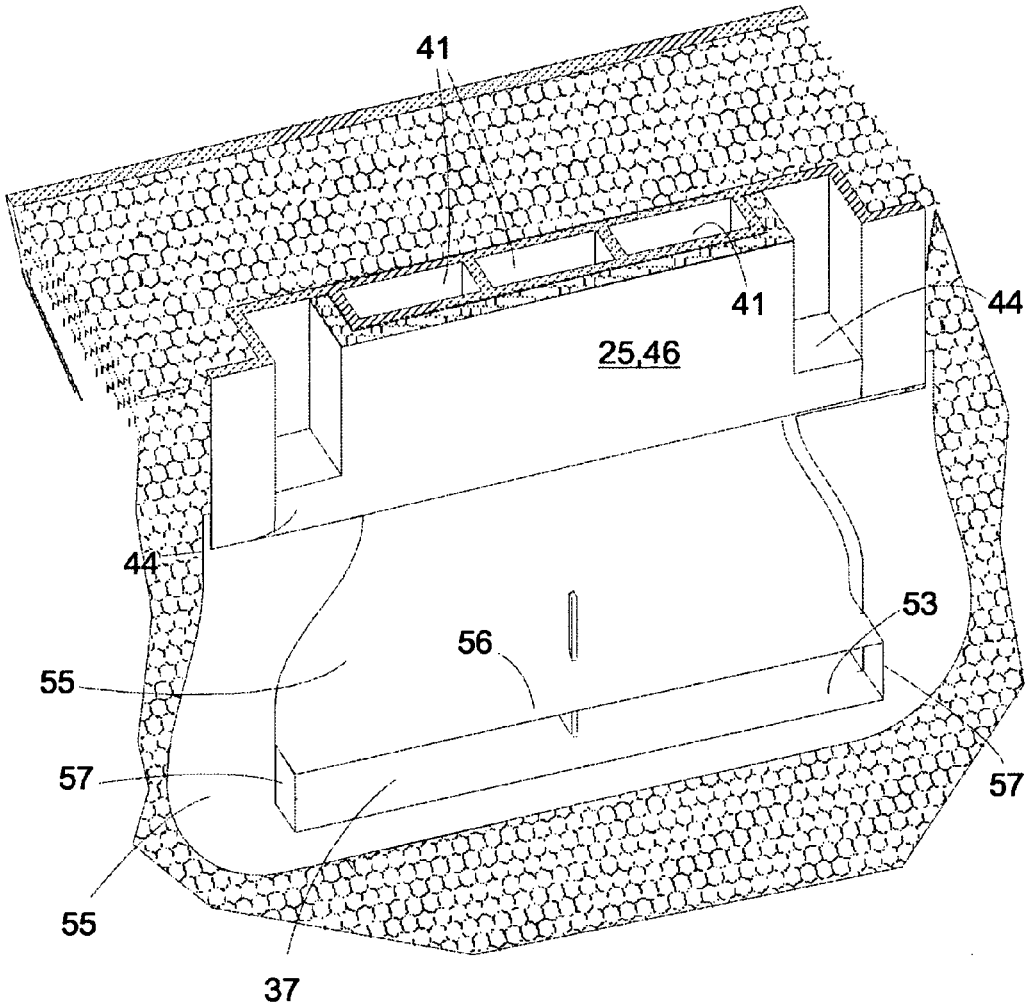
FIG. 5 shows a view similar to that of FIG. 4 with the guide wall.

FIG. 5 shows the same view as FIG. 4, but with a guide plate 55 positioned in the shell 51, said guide plate extending in a continuously curving manner from the lower edge of the insulating layer 25 and changing into a horizontal plate 56 parallel to the plate 53. The two plates 53, 56 and side walls 57 connecting them form a stub projecting out of the device back wall 8 into the second refrigerating area 6. The guide plate 55 has a slot inserted onto the ridge 54.

FIG. 5 shows an enlarged cross-section through the lower area of the cold-air supply pathway 24 and its surroundings. The partition 5 between the first refrigerating area 4 and the second refrigerating area 6 is a separate part from the remaining body of the refrigerating device, said part being removably held in a plastic profile 58 which extends in a perpendicular manner across the back wall 8. The plastic profile 58 separates a plate 59 made of stainless steel sheet which forms the inner skin of the back wall 8 in the first refrigerating area 4 from a corresponding plate 60 of the second refrigerating area 6 lying thereunder and in this way prevents a direct flow of heat between the refrigerating areas 4, 6 over a metal bridge.

The guide plate 55 in the interior of the back wall 8 extends behind the plastic profile 58. Together with the shell 51, it lengthens, with no cross-sectional stages, the cold-air supply pathway 24 beyond the lower end of the extruded profile 35 and in this way produces a low-turbulence redirection of the air flow in the horizontal direction and into the first distributor chamber 27 of the second refrigerating area 6. The guide plate fits snugly with a wall 61 of the extruded profile 35 that separates the channels 41 from the insulating layer 25 and connects this wall without cross-sectional discontinuities or kinks to the upper edge of the cold-air feed aperture 37. In an alternative embodiment, in which the insulating layer itself forms the wall 61 of the channels 41, the guide plate can also fit directly in a flush manner onto the end of the insulating layer.

In a simpler model of a refrigerating device, which is not subdivided by a partition into refrigerating areas to be kept at different temperatures, the extruded profile 35 and the inner skin define a single cold-air pipe, which communicates via the apertures 14 with the inner chamber and is also closed off at its lower end by the shell 51 which diverts the air to a last through-opening into the inner chamber. In this simpler device, the guide plate 55 and the insulating layer 25 are omitted; shell 51 and extruded profile 35 can, however, be the same in both devices.

The invention claimed is:

1. A refrigerator comprising:

a.) a housing having at least one wall, the housing enclosing a first cooling compartment and a second cooling compartment, the at least one wall having an insulating layer;

b.) a wall-extending distributor pipe that extends along the at least one wall of the first cooling zone and is separated therefrom by the insulating layer;

c.) an air inlet that opens into the second cooling compartment;

d.) a transition section for communicating the wall-extending distributor pipe and the air inlet that opens into the second cooling compartment with one another such that cold air flows from a cold air source along the wall-extending distributor pipe and thereafter through the transition section to the air inlet for introduction of cold air into the second cooling compartment by the air inlet; and e.) a guide element that extends from one end of the insulating layer to an edge of the air inlet opening that is proximate to the one end of the insulating layer, the guide element connecting in a continuous manner a pipe surface of the wall-extending distributor pipe that is proximate to the insulating layer to the proximate edge of the air inlet.

2. The refrigerator as claimed in claim 1, wherein the guide element is continuously curved between the end of the wall-extending distributor pipe and the air inlet that opens into the second cooling compartment.

3. The refrigerator as claimed in claim 1, wherein the transition section includes an outer shell that connects in a continuously curved manner a side of the wall-extending distributor pipe facing away from the first cooling compartment to an edge of the air inlet facing away from the end of the wall-extending distributor pipe and fits in a foam-tight manner with an inner skin of the at least one wall of the housing.

4. The refrigerator as claimed in claim 3, wherein the guide element is incorporated in the shell.

5. The refrigerator as claimed in claim 4, wherein the shell has a ridge protruding into its interior and the guide element has a slot penetrated by the ridge.

6. The refrigerator as claimed in claim 1, wherein the first cooling compartment and the second cooling compartment are subdivided by a partition and the wall-extending distributor pipe and the air inlet that opens into the second cooling compartment are located on different sides of the partition.

7. The refrigerator as claimed in claim 6, wherein a metal inner skin of the at least one wall of the housing is interrupted between the one end of the insulating layer and the edge of the air inlet that is proximate to the one end of the insulating layer.

* * * * *